United States Patent [19]

Wade

[11] Patent Number: 4,641,496

[45] Date of Patent: Feb. 10, 1987

[54] CONTINUOUS ROTARY REGENERATION SYSTEM FOR A PARTICULATE TRAP

[75] Inventor: Wallace R. Wade, Farmington Hills, Mich.

[73] Assignee: Ford Motor Company, Dearborn, Mich.

[21] Appl. No.: 682,523

[22] Filed: Dec. 17, 1984

[51] Int. Cl.[4] ..... F01N 3/02

[52] U.S. Cl. ..... 60/274; 55/272; 55/283; 55/DIG. 30; 60/303; 60/311

[58] Field of Search ..... 60/274, 303, 311; 55/283, 272, DIG. 10, DIG. 30

[56] References Cited

U.S. PATENT DOCUMENTS

| | | | |
|---|---|---|---|
| 4,276,066 | 6/1981 | Bly | 60/311 |
| 4,359,864 | 11/1982 | Bailey | 60/311 |
| 4,427,418 | 1/1984 | Kogiso | 60/303 |
| 4,481,767 | 11/1984 | Stark | 60/303 |

*Primary Examiner*—Douglas Hart

*Attorney, Agent, or Firm*—Joseph W. Malleck; Roger L. May

[57] ABSTRACT

An apparatus and method for continuously regenerating a particulate filter trap comprises: movable means effective to shield a segment of the trap entrance face from the full flow of exhaust gas while permitting a portion of the exhaust gas flow to bleed therethrough; (b) electrical resistance heating means having a movable heating element carried by the shield and interposed between the trap face and the shield; and (c) means for substantially continuously moving the shield and element conjointly across the trap face to ignite one or more columns of the particulates in the trap aligned with the shield and element. The ignited particles and bleed flow cause oxidation to proceed throughout the extent of the columns of particulates without need for additional exterior heat.

8 Claims, 3 Drawing Figures

CONTINUOUS ROTARY REGENERATION SYSTEM FOR A PARTICULATE TRAP

TECHNICAL FIELD

This invention is directed to electrical regeneration systems for particulate traps used with diesel type engines and, more particularly, to an apparatus and method which permits such electrical regeneration system to operate on a continuous basis and yet be more economical, less complex, and more reliable.

BACKGROUND OF INVENTION AND PRIOR ART STATEMENT

Regeneration systems for particulate traps for diesel engines have typically employed an auxiliary fuel burner unit which elevated the temperature of gases flowing through the trap to bring about carbon ignition and oxidation. One type is based upon the concept of bypassing exhaust gases during the regeneration cycle so that the filter or trap portion from which the exhaust gases have been removed can then be heated to an oxidation temperature for removing the particulates. In such bypass type of regeneration system, the total apparatus assembly usually requires a sizable number of components, including a trap (such as a ceramic honeycomb with alternately blocked channels), bypass valve and channel apparatus, a fuel pump and associated nozzle for delivering a well-atomized fuel spray, an air pump for supplying combustion air, ignition means for igniting the combustible fuel/air mixture for additional heat content to the exhaust flow, a control system to detect when to initiate regeneration based on the ratio of trap back-pressure to the clean trap back-pressure, and a control system to sequence the bypass of the exhaust flow, initiate heating, and turn off the ignition system when the regeneration is complete. Such an apparatus is shown in U.S. Pat. No. 4,167,852. This apparatus is complex and expensive because of the number of elements that make up the assembly. For example, the controls to detect when to initiate the regeneration and the controls to sequence the bypass of the exhaust valve, as well as the fuel pump, air pump, and the bypass valve and channel structure, are all rather expensive and complex items which place a heavy burden on the designer to assure reliability.

Electrical regeneration systems may tend to offer greater reliability and are known in the art. One such electrical system is disclosed, in U.S. application Ser. No. 573,277, now U.S. Pat. No. 4,544,388 (assigned to the assignee of this invention) wherein, in place of the fuel pump and nozzle, an electric heater is employed along with an air pump and a temperature control to ignite the particulates in the section of the filter that has been bypassed. Comparatively speaking, this apparatus requires unusually high power to heat the entire flow that goes through the filter portion; this requires a large, heated flow and accompanying complex controls to carry out the necessary heating. It would be desirable if such bypass system could be substantially reduced to a more simple structure to accomplish the regeneration without the necessity for such controls.

Another type of electric regeneration system is of the shifting heater type where a unitary filter trap is progressively and sequentially cleansed by either rotating an electrical heating element across the face of the filter, as shown in U.S Pat. No. 4,359,864, or the electrical heating elements are embedded in the ceramic filter itself and are sequentially energized to carry out a movable heating of different sections of the filter while a movable shield is carried across the face of the filter to block off exhaust flow in that portion of the filter in which the electrical elements have been energized, as shown in U.S. Pat. No. 4,276,066.

U.S. Pat. No. 4,359,864 is disadvantageous because it requires a full flow of exhaust gas through the entire filter at all times, and because the electrical heating element configuration, shaped as a rod which is rotationally scanned across the face of the filter element, much like the hand of a clock, has inadequate contact with the total gas flowing therethrough. The amount of electrical power required for such heating element must be great enough to heat the large exhaust gas flow which is passing thereacross and to raise such exhaust gas flow to a substantial temperature level permitting ignition of the particulates. This is a particularly inefficient method for bringing about the ignition of particulates since it is the temperature of the flow through the filter which brings about the ignition, such flow receiving its heat content from the electrical heating element. Thus, this patent demonstrates a disclosure which is not feasible because the electrical resistance heater must heat the total exhaust flow, which requires more energy than can be generated in conventional on-board resistance heater elements.

With respect to U.S. Pat. No. 4,276,066, the heating elements are embedded in the ceramic filter trap and encounter the problem of the thermal expansion of the heating element in the ceramic in the trap tending to crack the ceramic. With a cracked ceramic matrix, the trapping efficiency of the trap drops to very low levels. In addition, the resistance heater must be the sole mechanism for carrying out ignition of each and every particulate, since all exhaust flow through the energized elements is blocked off during such regeneration.

What is needed is a rotary type of electrical regeneration system which: (a) does not suffer from the problem of electrical heating elements embedded within ceramic; (b) does not require heating of the entire full flow of exhaust gas to bring about combustion of the particulates; and (c) will provide conjoint movement of a reduced, shielded, oxidizing gas flow and a segmental heater about the filter face.

SUMMARY OF THE INVENTION

The invention is an apparatus and method for continuously regenerating a particulate filter trap for an internal combustion engine. The apparatus has means for normally conducting the exhaust gas of the engine to and through the trap, the trap having a plurality of generally aligned flow channels extending from the entrance face of the trap. The apparatus particularly comprises: (a) movable means effective to shield a segment of the trap entrance face from the full flow of exhaust gas while permitting a portion of the exhaust gas flow to bleed therethrough; (b) electrical resistance heating means having a movable heating element carried by the shield and interposed between the trap face and the shield; and (c) means for substantially continuously moving the shield and element conjointly across the trap face to ignite one or more columns of the particulates in the trap aligned with the shield and element, the ignited particles and bleed flow causing the oxidation to proceed throughout the extent of the columns of particulates without need for additional exterior heat.

Preferably the particulate trap is constructed as a cylinder with its face formed as a circle, the shield being constituted as a sector of the circle effective to rotate about the face of the trap utilizing the apex of the sector as the axis of rotation. Advantageously the shield is a 60° sector moved in a full 360° rotational scan. Preferably the bleed flow is provided by the presence of bleed holes in the shield spaced uniformly across the shield sufficient to provide a bleed flow rate of about 0.12 lb/min. Advantageously, the shield segment is moved across the face of the trap at a slow speed of about one revolution in 30 minutes. The heating element is sized to heat the bleed flow to a temperature of at least 1000° F. and optimally to 1200° F., utilizing a power source of only about 500 watts.

The method of regenerating the particulate trap, comprises: (a) slowly and conjointly moving a segmental shield and electrical heating element across the entrance face, while heating the shielded portion of the entrance face to a particulate ignition temperature, the segmental shield blocking off the full flow of the exhaust gases from the portion of the entrance face covered by the shield, while permitting a portion of the exhaust gases to bleed therethrough; and (b) controlling the movement of the shield and element to allow the heated bleed gas to ignite one or more columns of particulates in the trap aligned with the shield and element and to support oxidation of the particulates substantially along the entire length of the columns. Preferably the heating element and shield conform in configuration to a sector of a circle; the shield and element are rotated about the apex of such sector, the rotary movement being at a speed of about one revolution per 30 minutes.

DETAILED DESCRIPTION AND BEST MODE

Figure 1:
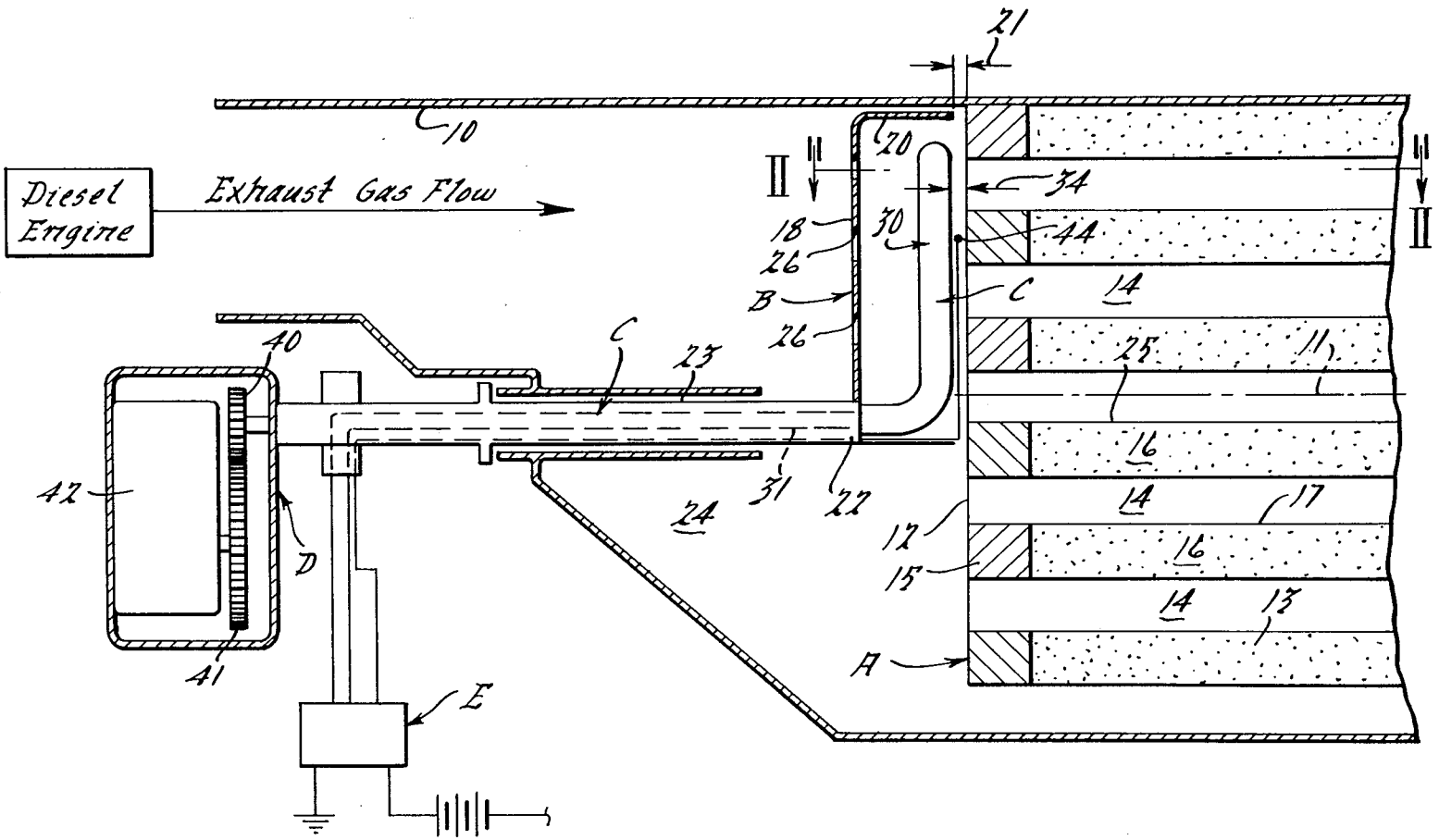
FIG. 1 is a central sectional elevational view of a portion of the particulate trap and of an assembly for the rotary regenerator of this invention.

Turning to the figures, the apparatus comprises essentially a trap A, an exhaust flow shielding means B, an electric heating means C, a continuous mover means D, and a power supply and control E. The regenerative apparatus and system of this invention are adapted for use with an automotive internal combustion engine, such as a diesel engine, that emits carbon particulates by way of the exhaust gas flow therefrom. The exhaust gas is channeled by walls 10 from the engine to the on-board trap A which collects particulates at a rate and in a quantity much greater than can be held by the trap over its life without regeneration; thus, the trap A must be cleansed periodically through a regenerative cycle or system.

The trap is here cylindrically shaped, having a cylindrical axis 11 with the exhaust gas flow flowing along the axis therethrough after having entered through a circular face 12 of the trap at one end thereof. The trap has a filter element 13 operative to filter out and collect a substantial portion of the entrained particulates in the exhaust gas that is permitted to flow therethrough. The filter element may preferably be comprised of a rigid or fibrous ceramic such as aluminum silicate or mullite aluminum titanate or cordierite. In any case, the ceramic material is formed in a honeycomb structure with alternately blocked straight channels in a well known manner (see reference SAE 810114). The filter is encased in a housing 10, all of the walls being preferably formed of stainless steel. The mode of entrapment of such honeycomb ceramic filter is by way of interception; particulates larger than approximately the mean pore size of the ceramic material are intercepted and prevented from passing through the ceramic. The ceramic is preferably formed in parallel channels 14–15 which extend substantially throughout the length of the ceramic filter parallel to the axis of such trap. Alternate channels are plugged (at 15) at the frontal face of the filter element, and the unplugged channels 14 are then plugged at the trailing end of each of the channels. In this manner exhaust flow entering the unplugged channels 1 through the frontal face 12 of the filter must pass through the porous walls 17 of such elongated channels to enter a channel 16 which has an exit opening at the trailing end of the trap.

Figure 3:
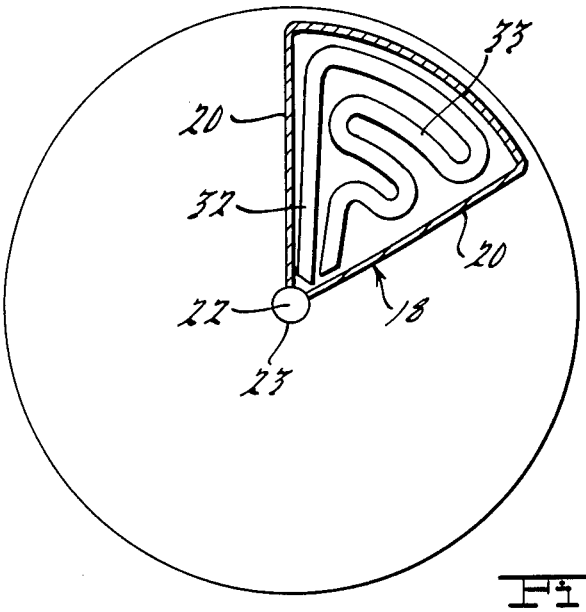
FIG. 3 is an end elevational view of the entrance face to the trap, taken substantially along lines 3—3 of FIG. 2.
Figure 2:
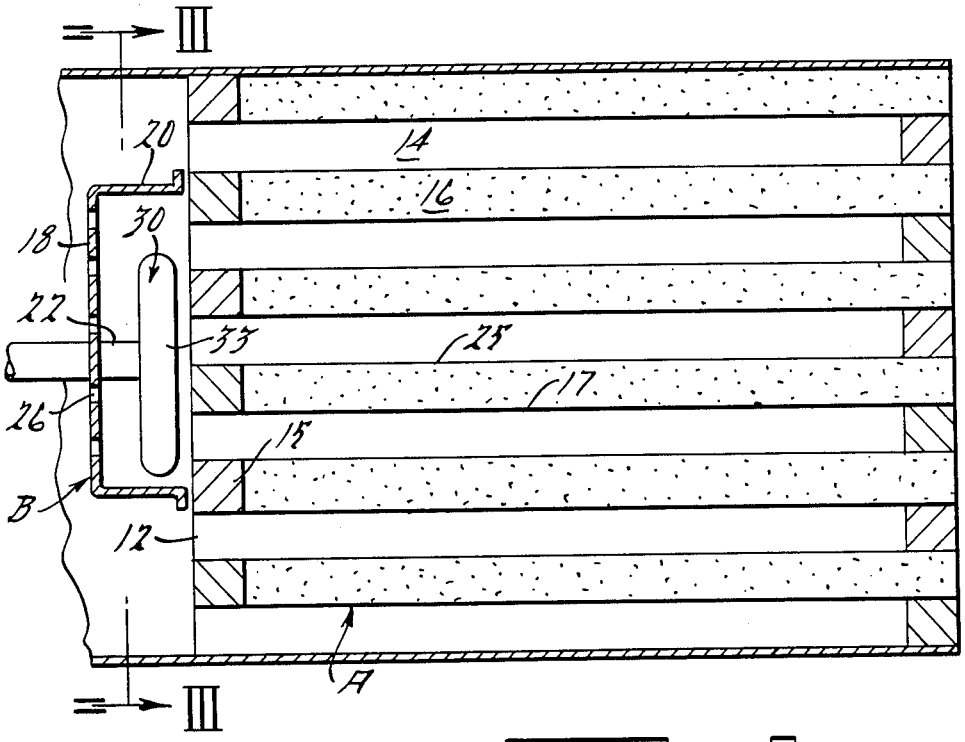
FIG. 2 is a sectional view of a portion of the illustration in FIG. 1 taken in the direction of lines 2—2 indicated 1.

The movable means B, effective to shield a segment of the trap entrance face 12, comprises a metallic cover 18, which in an elevational view is pie-shape, to occupy a sector of a circle of approximately 60° (45°–75°), such as shown in FIG. 3. The cover has side walls 20 which extend toward the filter element to be juxtaposed with a space 21 therebetween of less than 0.010 inch to minimize leakage. The cover 18 is attached at its center or apex 22 to a tube 23 which extends normal to the plane of the cover and face 12, the tube 23 extends through and outwardly from the plenum chamber 24 (leading the exhaust gases to the filter element).

The exhaust flow from the engine is carried by way of walls 10 and the plenum chamber to the frontal face 12 of the filter element; normally such flow would be permitted to enter all of the available entrance channels 14 of the filter element. However, the shield means B blocks off such full flow of exhaust gases from those channels 14 (and the columns of particulates 25 associated with the walls of such channels) which are aligned with the cover (when the cover is projected onto the face of the filter element as viewed along an axial direction, as shown in FIG. 3). Small bleed holes 26 are formed in the cover of the shield means so as to allow a bleeding of a small portion of the exhaust gas therethrough. Such holes are preferably sized to have a diameter of about 0.050 inch and are used in a number, such as approximately 9, distributed evenly across such cover. The normal exhaust gas flow for a 2.3 L diesel engine at 2500 rpm will be about 7.6 lb/min, and the bleed flow will be reduced substantially to an amount of about 0.12 lb/min.

The electrical heater C comprises a wire heating element 30 which continuously extends as a resistance strand from a central shaft portion 31 passing through the apex 22 of the shield and extends radially outwardly at 32 to return along a serpentine configuration portion 33 extending radially inwardly to terminate adjacent the apex 22. The configuration occupies a substantial projected area of the cover. The heating element 30 is interposed between the cover 18 and the filter element 13; the element 30 has one side spaced from the filter entrance face a distance 34 of less than 0.080 inch. The heating element consists of a nichrome resistance element contained in magnesium oxide powder insulation with a 0.260 in diameter stainless steel sheath; the heating element is typically supplied with about 500 watts (300–800 watts) to elevate the temperature of the bleed gases passing thereacross to a temperature of at least 1000° F. and preferably to at least about 1200° F.

The central shaft portion 31 of the heating element is journalled in the tube 23 of the shielding means in a manner so as to be conjointly carried therewith as the cover is rotated. Electrical lead wires 35 are connected to the central shaft portion 31 of the heating element 30 and extend outwardly from such tube through slip rings providing a connection to a power supply and control E, remote from the heating element.

The continuous mover means D rotationally actuates the cover and heating element assembly, means D comprises a spur gear 40 connected to one end of the tube 23 of the shield means and shaft portion 31 of the heater means, so as to drive such tube 23, shield 18 and element 30 rotationally. A reduction gear 41 is meshed with the spur gear and is drivingly connected to an electrical motor 42, as shown in FIG. 1. The reduction gear is selected so as to provide a rotational movement of the shield means tube of about one revolution per 30 minutes. This provides five minutes of heating time for each channel which is necessary to initiate regeneration. A reduced rotational speed may be required to provide an adequate level of particulates to ensure self-sustaining regeneration in each channel.

The control E is comprised a simple bi-metallic thermostat 44 stationed at a position between the electrical heating element and the entrance face 12 of the filter element. The thermostat is used as a control to prevent overheating of the electric resistance elements. The thermostat is of the slow response type, which is adequate for a continuously heated system such as illustrated herein. This slow response thermostat does not require heat up periodically as in prior art systems.

The method of this invention for regenerating a particulate trap and the operation of the apparatus herein, is as follows: (a) slowly and conjointly moving a segmental shield and an electrical heating element across the entrance face of the trap while heating the shielded portion of the entrance face to a particulate ignition temperature, the segmental shield blocking off the full flow of the exhaust gases from the portion of the entrance face covered by the shield while permitting a sequestered portion of the flow to bleed through the shield and across the heating element; and (b) controlling the movement of the shield and element to allow the heated bleed gas to ignite one or more columns of particulates in the trap aligned with the shield and element to support oxidation of the particulates substantially along the entire length of the columns.

By following the above method steps, the bleed gas and a segment of the entrance face 12, as covered or scanned by the electrical heating element, will be heated to a temperature of about 1200° F. The power requirement for carrying this out will be about 500 watts. This is based on data from previous systems which required 3000 watts to heat the entire inlet face of the trap. The 60° segment of the entrance face will only require one-sixth of such 3000 watts or approximately 500. The six-fold reduction in electrical power requirement has a major advantage in reducing the alternator power requirement for the regenerator system. Particulate oxidation is, of course, initiated by the electrically heated bleed gases flowing thereover, but continued oxidation of the particulate columns is supported simply by further bleed gases or exhaust gases supplying the necessary oxygen to support combustion; additional input heat is not necessary. In a sense, the unshielded portion of the trap filter is a bypass; that is, the full flow of exhaust gas is prevented from flowing through such covered segment and is forced to bypass therearound. However, the necessity for complex channeling structures is eliminated and the system is continuous. After the shield and electrical element has rotated a full 360°, it is ready to be rotated continuously again so that the trap filter is continuously regenerated at intervals depending upon the completion of one rotation of such elements.

This system eliminates the need for many of the components required in previous prior art electrical regenerations systems, such as: a bypass valve, bypass channel, air pump, 83% of the electrical heating wire is not needed, a sophisticated fast response temperature control, a back pressure sensing system, and dual controls for initiating sequencing of the regeneration. As a result, the system is considerably more economical, less complex, and more reliable in operation to carry out regeneration over the life of the vehicle.

I claim:

1. An apparatus for continously regenerating a particulate trap for an internal combustion engine, the apparatus having means for normally conducting exhaust gas flow of the engine to and through the entrance face of the trap, the entrance face of the trap being a circle, the trap having a plurality of generally aligned flow channels extending from the entrance face and along which columns of said particulates are collected, the apparatus comprising:

(a) movable means effective to shield a sector of said circle of said trap entrance face from the full flow of said exhaust gas, while permitting a portion of said exhaust gas flow to bleed therethrough at a flow rate substantially less than the flow rate of said exhaust gas flow;

(b) electrical resistance heating means having a moveable heating element carried only by said shield and interposed between said filter trap face and said shield; and (c) means for substantially moving said shield and element conjointly about the apex of said sector to traverse the entire frontal entrance face of said trap to ignite one or more columns of the particulates in said trap aligned with said shield and element, said ignited particles and bleed flow causing oxidation to proceed throughout the extent of said columns of particulates without need of additional exterior heat.

2. An apparatus for continuously regenerating a particulate trap for an internal combustion engine, the apparatus having means for normally conducting exhaust gas flow of the engine to and through the entrance face of the trap, the trap having a plurality of generally aligned flow channels extending from the entrance face and along which columns of said particulates are collected, the apparatus comprising:

(a) movable means effective to shield about a 60° sector of a circle of said trap entrance face from the full flow of said exhaust gas flow, while permitting a portion of said exhaust gas flow to bleed therethrough;

(b) electrical resistance heating means having a moveable heating element carried by said shield and interposed between said filter trap face and said shield; and (c) means for substantially continuously moving said shield and element conjointly across said trap entrance face to ignite one or more columns of the particulates in said trap aligned with said shield and element, said ignited particles and bleed flow causing oxidation to proceed throughout the extent of said columns of particulates without need of additional exterior heat.

3. The apparatus as in claim 2, in which said bleed flow is provided by bleed holes spaced uniformly across said shield.

4. The apparatus as in claim 3, in which said bleed holes are sufficient to provide a flow rate of about 0.12 lb/min through said heating element and trap.

5. The apparatus as in claim 1, in which said continuous movement of said shield and element is at a rotary rate of about one revolution per 30 minutes.

6. The apparatus as in claim 1, in which said element is supplied with sufficient power to heat the gas flow entering said entrance face to a temperature of at least 1000° F.

7. The apparatus as in claim 6, in which said electrical resistance heating means has a power source of about 500 watts.

8. A method of regenerating a particulate trap having an entrance face and a plurality of generally aligned flow channels extending from the entrance face and along which columns of said particulates are collected as exhaust gases flow therethrough, comprising:

(a) slowly and conjointly rotating a segmental shield and an electrical heating element across said entrance face while heating the shielded portion of said entrance face to a particulate ignition temperature, said heating element being interposed between said shield and entrance face and said segmental shield blocking off the full flow of said exhaust gases from the portion of the exhaust gases to bleed therethrough, said bleed flow being substantially less than the flow of said exhaust gas; and (b) controlling the movement of said shield and element to allow the heated bleed gas to ignite one or more columns of particulates in the trap aligned with said shield and element and to support oxidation of the particulates substantially along the entire length of the columns.

* * * * *